US010551064B2

(12) United States Patent
Rullaud et al.

(10) Patent No.: US 10,551,064 B2
(45) Date of Patent: Feb. 4, 2020

(54) ANNULAR WALL OF A COMBUSTION CHAMBER WITH IMPROVED COOLING AT THE LEVEL OF PRIMARY AND/OR DILUTION HOLES

(71) Applicants: SAFRAN AIRCRAFT ENGINES, Paris (FR); SAFRAN HELICOPTER ENGINES, Bordes (FR)

(72) Inventors: Matthieu Francois Rullaud, Champagne sur Seine (FR); Bernard Joseph Jean-Pierre Carrere, Pau (FR); Hubert Pascal Verdier, Nay (FR)

(73) Assignees: SAFRAN AIRCRAFT ENGINES, Paris (FR); SAFRAN HELICOPTER ENGINES, Bordes (FR)

( * ) Notice: Subject to any disclaimer, the term of this patent is extended or adjusted under 35 U.S.C. 154(b) by 348 days.

(21) Appl. No.: 14/352,946

(22) PCT Filed: Oct. 25, 2012

(86) PCT No.: PCT/FR2012/052446

§ 371 (c)(1),
(2) Date: Apr. 18, 2014

(87) PCT Pub. No.: WO2013/060987

PCT Pub. Date: May 2, 2013

(65) Prior Publication Data

US 2014/0260257 A1 Sep. 18, 2014

(30) Foreign Application Priority Data

Oct. 26, 2011 (FR) ..... 11 59704

(51) Int. Cl.
*F23R 3/06* (2006.01)
*F23R 3/00* (2006.01)

(52) U.S. Cl.
CPC ..... *F23R 3/002* (2013.01); *F23R 3/06* (2013.01); *F23R 2900/03041* (2013.01); *F23R 2900/03042* (2013.01)

(58) Field of Classification Search
CPC .... F23R 3/06; F23R 3/50; F23R 3/002; F23R 3/007; F23R 3/346; F23R 2900/03041–03045
See application file for complete search history.

(56) References Cited

U.S. PATENT DOCUMENTS 4,923,371 A * 5/1990 Ben-Amoz ..... F01D 5/186 415/115
5,000,005 A * 3/1991 Kwan ..... F01D 5/184 431/352

(Continued)

OTHER PUBLICATIONS

International Search Report dated Nov. 15, 2013 in PCT/FR2012/052446 filed Oct. 25, 2012.

*Primary Examiner* — Jason H Duger
*Assistant Examiner* — Rene D Ford
(74) *Attorney, Agent, or Firm* — Oblon, McClelland, Maier & Neustadt, L.L.P.

(57) ABSTRACT

An annular wall of a combustion chamber of a turbine engine including: a cold side and a hot side; plural dilution holes to allow circulating air of the cold side to enter the hot side for dilution of an air/fuel mixture; plural cooling orifices to allow the circulating air of the cold side to enter the hot side to form a film of cooling air along the annular wall, the cooling orifices distributed spaced axially from one another and with geometric axes inclined, in an axial direction of flow of combustion gases, by an inclination angle relative to a normal to the annular wall; plural additional cooling orifices arranged directly downstream of the dilution holes and distributed spaced axially from one another, with geometric axes arranged in a plane perpendicular to the axial (Continued)

direction and inclined by an angle of inclination relative to a normal to the annular wall.

11 Claims, 2 Drawing Sheets

(56) References Cited

U.S. PATENT DOCUMENTS 5,241,827 A * 9/1993 Lampes ..... F01D 5/184 60/754
5,261,223 A * 11/1993 Foltz ..... F23R 3/002 60/757
6,145,319 A * 11/2000 Burns ..... F23R 3/002 60/754
6,205,789 B1 * 3/2001 Patterson ..... F23R 3/002 60/754
6,408,629 B1 * 6/2002 Harris ..... F23R 3/06 60/754
6,513,331 B1 * 2/2003 Brown ..... F23R 3/06 60/754
7,748,222 B2 * 7/2010 Bernier ..... F23R 3/002 60/752
8,104,288 B2 * 1/2012 Woodcock ..... F23R 3/06 60/752
2003/0106317 A1 * 6/2003 Jorgensen ..... F01D 9/023 60/722
2004/0168786 A1 * 9/2004 Isano ..... B22D 25/005 164/61
2006/0059918 A1 * 3/2006 Caldwell ..... F23R 3/06 60/772
2006/0196188 A1 * 9/2006 Burd ..... F23R 3/002 60/754
2007/0084219 A1 4/2007 Bernier et al.
2007/0169484 A1 * 7/2007 Schumacher ..... F23R 3/002 60/754
2009/0084110 A1 4/2009 Dudebout et al.
2009/0272124 A1 * 11/2009 Dawson ..... F23R 3/06 60/806
2011/0023495 A1 2/2011 Bronson et al.

* cited by examiner

ANNULAR WALL OF A COMBUSTION CHAMBER WITH IMPROVED COOLING AT THE LEVEL OF PRIMARY AND/OR DILUTION HOLES

BACKGROUND OF THE INVENTION

The present invention relates to the general field of turbine engine combustion chambers. It focuses more particularly on an annular wall for direct or reverse-flow combustion chamber cooled by a process known as «multiperforation».

Typically, an annular turbine engine combustion chamber is formed by an internal annular wall and an external annular wall which are connected upstream by a transversal wall forming the chamber base.

The internal and external annular walls are each provided with a plurality of various holes and orifices enabling circulating air around the combustion chamber to penetrate inside the latter.

In this way, holes called «primary» and «dilution» are formed in these annular walls to convey air inside the combustion chamber. The air using the primary holes contributes to creating an air/fuel mixture which is burnt in the chamber, while the air originating from the dilution holes is intended to favour dilution of this same air/fuel mixture.

The internal and external annular walls undergo high temperatures of gas originating from the combustion of the air/fuel mixture.

To ensure their cooling, additional so-called multiperforation orifices are also bored through these annular walls over their entire surface. These multiperforation orifices, inclined generally at 60°, allow the circulating air outside the chamber to penetrate inside the latter for forming cooling air films along the walls.

However, in practice, it has been noted that the zone of the internal and external annular walls which is situated directly downstream of each of the primary or dilution holes, due especially to the absence of orifices resulting from the laser boring technology used, benefits from a low level of cooling with the risk of cracks forming, as this implies.

To resolve this problem, document U.S. Pat. No. 6,145,319 proposes making transition holes in the wall zone located directly downstream of each of the primary and dilution holes, these transition holes having less inclination than that of the multiperforation orifices. However, given that this is localised treatment, this solution regrettably proves particularly costly and significantly prolongs manufacture of the walls.

OBJECT AND SUMMARY OF THE INVENTION

The aim of the present invention is to rectify such disadvantages by proposing an annular combustion chamber wall which ensures adequate cooling of the zones located directly downstream of the primary and dilution holes.

For this purpose, an annular turbine engine combustion chamber wall is provided, comprising a cold side and a hot side, said annular wall comprising:

- a plurality of primary holes distributed according to a circumferential row to allow circulating air of the cold side of said annular wall to enter the hot side to create an air/fuel mixture;
- a plurality of dilution holes distributed according to a circumferential row to allow circulating air of the cold side of said annular wall to enter the hot side to ensure dilution of the air/fuel mixture; and

- a plurality of cooling orifices to allow circulating air of the cold side of said annular wall to enter the hot side to form a film of cooling air along said annular wall, said cooling orifices being distributed according to a plurality of circumferential rows spaced axially from one another and the geometric axes of each of said cooling orifices being inclined, in an axial direction D of flow of combustion gases, by an angle of inclination θ1 relative to a normal N to said annular wall;

characterised in that it further comprises a plurality of additional cooling orifices arranged on the one hand directly downstream of said primary holes and on the other hand directly downstream of said dilution holes and distributed according to a plurality of circumferential rows spaced axially from one another, the geometric axes of each of said additional cooling orifices being arranged in a plane perpendicular to said axial direction D and inclined by an angle of inclination θ2 relative to a normal N to said annular wall.

The presence of additional cooling orifices arranged inclined in a plane perpendicular to the direction of flow of combustion gases, directly downstream and close to the primary and dilution holes, ensures efficacious cooling relative to classic axial multiperforation where the film of air is stopped by the presence of these holes, and without modifying the flow in the primary zone.

Preferably, it further comprises at the level of a transition zone formed downstream of said plurality of rows of additional orifices at least two rows of orifices whereof the geometric axes of each of said orifices are inclined, relative to a plane perpendicular to said axial direction D, by an inclination determined as different for each of said two rows.

According to another embodiment, the annular turbine engine combustion chamber wall comprising a cold side and a hot side can also comprise:

- a plurality of primary holes or dilution holes distributed according to a circumferential row to allow circulating air of the cold side of said annular wall to enter the hot side to respectively create an air/fuel mixture or ensure dilution of the air/fuel mixture; and
- a plurality of cooling orifices to allow the circulating air of the cold side of said annular wall to enter the hot side to form a film of cooling air along said annular wall, said cooling orifices being distributed according to a plurality of circumferential rows spaced axially from one another and the geometric axes of each of said cooling orifices being inclined, in an axial direction D of flow of combustion gases, by an angle of inclination θ1 relative to a normal N to said annular wall;

characterised in that it further comprises a plurality of additional cooling orifices arranged directly downstream of said primary holes or dilution and distributed according to a plurality of circumferential rows spaced axially from one another, the geometric axes of each of said additional cooling orifices being arranged in a plane perpendicular to said axial direction D and inclined by an angle of inclination θ2 relative to a normal N to said annular wall, and in that it further comprises at the level of a transition zone formed downstream of said plurality of rows of additional orifices at least two rows of orifices whereof the geometric axes of each of said orifices are inclined, relative to a plane perpendicular to said axial direction D, by an inclination determined as different for each of said two rows.

By smoothing out flows this gyratory-axial multiperforation transition zone reduces the thermal gradient at the origin of the onset of cracks. The average temperature profile at the chamber output is improved due to the resulting more effective mixture.

According to an advantageous embodiment of the invention, said inclination θ2 of said additional orifices relative to the normal N to said annular wall is identical to that θ1 of said cooling orifices.

Advantageously, a diameter d2 of said additional orifices is identical to a diameter d1 of said cooling orifices and a pitch p2 of said additional orifices is identical to a pitch p1 of said cooling orifices and said additional orifices can have greater densification just downstream of the primary holes and the dilution holes.

When it comprises these two rows of orifices, said inclinations are 30° and 60° respectively. Said two rows of orifices are then either two rows of additional orifices arranged immediately upstream of a row of cooling orifices, or two rows of cooling orifices arranged immediately downstream of a row of additional orifices, or a row of additional orifices and an adjacent row of cooling orifices.

When it comprises several rows of orifices, said inclinations are distributed regularly between 0° and 90°.

Advantageously, the direction of inclination of said additional orifices is restricted by the direction of flow of the air/fuel mixture downstream of said combustion chamber.

Another aim of the present invention is a combustion chamber and a turbine engine (having a combustion chamber) comprising an annular wall such as defined previously.

BRIEF DESCRIPTION OF THE DIAGRAMS

Other characteristics and advantages of the present invention will emerge from the following description, in reference to the attached diagrams which illustrate an embodiment devoid of any limiting character. In the figures.

DETAILED DESCRIPTION OF THE INVENTION

Figure 1:
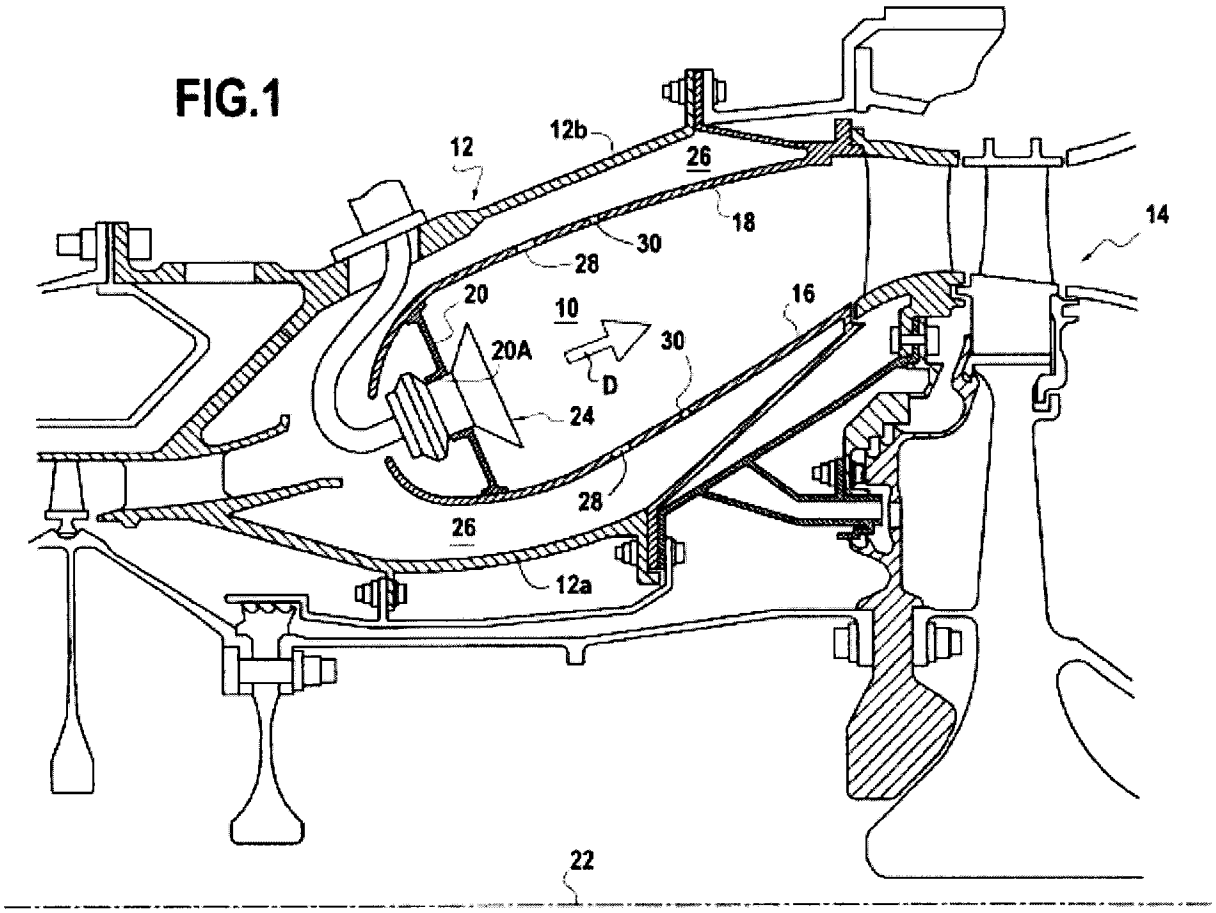
FIG. 1 is a view in longitudinal section of a turbine engine combustion chamber in its environment.

FIG. 1 illustrates in its environment a combustion chamber 10 for a turbine engine. Such a turbine engine comprises especially a compression section (not shown) in which air is compressed prior to being injected into a chamber housing 12, then into the combustion chamber 10 mounted inside the latter. The compressed air is introduced to the combustion chamber and mixed with fuel prior to being burnt. The gases coming from this combustion are directed to a high-pressure turbine 14 arranged at the outlet of the combustion chamber.

The combustion chamber is of annular type. It is formed by an internal annular wall 16 and an external annular wall 18 which are joined upstream by a transversal wall 20 forming the chamber base. It can be direct as illustrated or reverse-flow. In this case, a return elbow which can also be cooled by multi-drilling is placed between the combustion chamber and the turbine distributor.

The annular internal 16 and external 18 walls extend according to a longitudinal axis slightly inclined relative to the longitudinal axis 22 of the turbine engine. The chamber base 20 is provided with a plurality of openings 20A in which are mounted fuel injectors 24.

With the combustion chamber 10 the chamber housing 12, which is formed by an internal envelope 12*a* and an external envelope 12*b*, forms annular spaces 26 which admit compressed air intended for combustion, dilution and cooling of the chamber.

Figure 3:
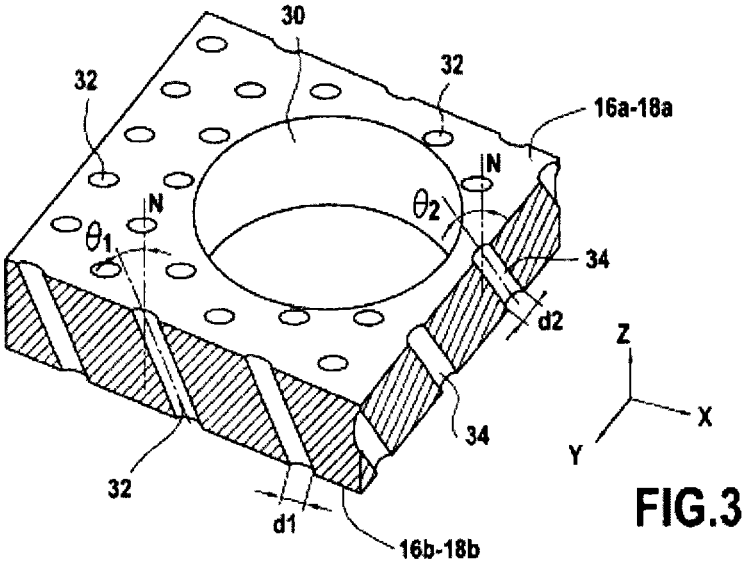
FIG. 3 is a partial perspective view of part of the annular wall of FIG. 2.

The annular internal 16 and external 18 walls each exhibit a cold side 16*a*, 18*a* arranged to the side of the annular space 26 in which compressed air circulates and a hot side 16*b*, 18*b* turned towards the interior of the combustion chamber (FIG. 3).

The combustion chamber 10 is divided into a zone called «primary» (or combustion zone) and a zone called «secondary» (or dilution zone) located downstream of the preceding one (downstream means relative to a general axial direction of flow of gases coming from the combustion of the air/fuel mixture inside the combustion chamber and materialised by arrow D).

The air which feeds the primary zone of the combustion chamber is introduced via a circumferential row of primary holes 28 made in the annular internal 16 and external 18 walls of the chamber over the entire circumference of these annular walls. These primary holes comprise a downstream edge aligned with the same line 28A. As for the air feeding the secondary zone of the chamber, it uses a plurality of dilution holes 30 also formed in the annular internal 16 and external 18 walls over the entire circumference of these annular walls. These dilution holes 30 are aligned according to a circumferential row which is offset axially downstream relative to the rows of primary holes 28 and they can have different diameters especially with alternating large and small holes. In the configuration illustrated in FIG. 2, these dilution holes of different diameters however have a downstream edge aligned with the same line 30A.

Figure 2:
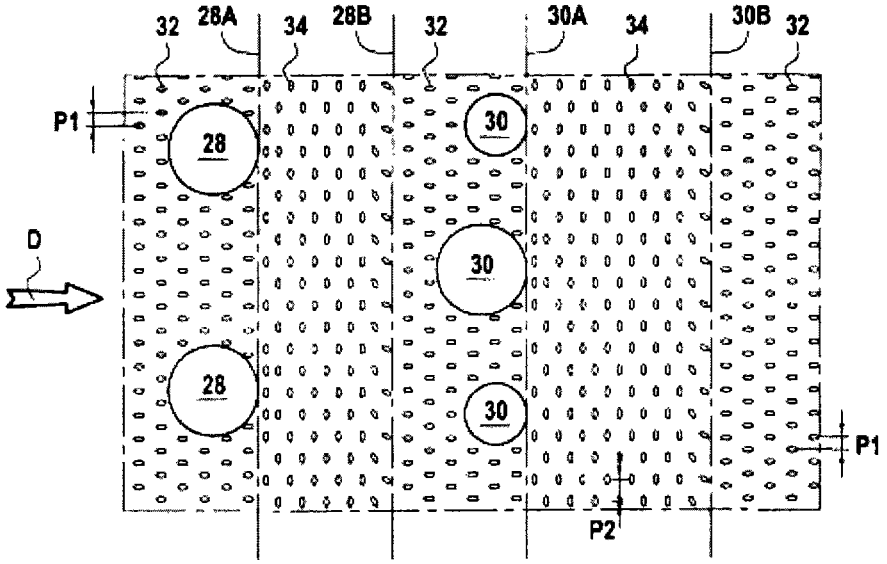
FIG. 2 is a partial and developed view of one of the annular walls of the combustion chamber of FIG. 1 according to an embodiment of the invention.

To cool the annular internal 16 and external 18 walls of the combustion chamber which are subjected to high temperatures from the combustion gases, a plurality of cooling orifices 32 is provided (illustrated in FIGS. 2 and 3).

These orifices 32, which ensure cooling of the walls 16, 18 by multiperforation, are distributed according to a plurality of circumferential rows spaced axially from one another. These rows of multiperforation orifices cover the entire surface of the annular walls of the chamber with the exception of particular zones forming the object of the invention precisely delimited and between the line 28A, 30A forming an upstream transition axis and a downstream transition axis offset axially downstream relative to this axis upstream and either substantially in front of the dilution holes (for the downstream axis 28B) or substantially in front of the outlet plane of the chamber (for the downstream axis 30B).

The number and diameter d1 of the cooling orifices 32 are identical in each of the rows. The pitch p1 between two orifices of the same row is constant and can be identical or not for all rows. Also, the adjacent rows of cooling orifices are arrows so that the orifices 32 can be arranged staggered as shown in FIG. 2.

As illustrated in FIG. 3, the cooling orifices 32 generally have an angle of inclination θ1 relative to a normal N to the annular wall 16, 18 through which they are made. This inclination θ1 allows the air using these orifices to form a film of air along the hot side 16*b*, 18*b* of the annular wall. Relative to the non-inclined orifices, it increases the surface of the annular wall which is cooled. Also, the inclination θ1 of the cooling orifices 32 is directed such that the resulting film of air flows in the direction of flow of the combustion gases inside the chamber (indicated by arrow D).

By way of example, for an annular wall 16, 18 made of metallic or ceramic material and having a thickness of between 0.6 and 3.5 mm, the diameter d1 of the cooling orifices 32 can be between 0.3 and 1 mm, the pitch d1 between 1 and 10 mm and their inclination θ1 between +30° and +70°, typically +60°. By way of comparison, for an annular wall having the same characteristics, the primary holes 28 and the dilution holes 30 have a diameter of the order of 4 to 20 mm.

According to the invention, each annular wall 16, 18 of the combustion chamber comprises, arranged directly downstream of the primary holes 28 and dilution holes 30 and distributed according to several circumferential rows, typically at least 5 rows, from the upstream transition axis 28A, 30A and as far as the downstream transition axis 28B, 30B, a plurality of additional cooling orifices 34. However, compared to the previous cooling orifices which deliver a film of air flowing in the axial direction D, the film of air delivered by these additional orifices flows in a perpendicular direction due to their disposition in a plane perpendicular to this axial direction D of flow of combustion gases. This multiperforation performed perpendicularly to the axis of the turbine engine (throughout description this will be referred to as gyratory multiperforation as opposed to axial multiperforation of the cooling orifices) brings together the additional orifices of the primary or dilution holes and improves the efficacy of the air/fuel mixture.

The additional orifices 34 of the same row have the same diameter d2, preferably identical to the diameter d1 of the cooling orifices 32, are spaced at a constant pitch p2 which can be identical or not to the pitch p1 between the cooling orifices 32 and have an inclination θ2, preferably identical to the inclination θ1 of the cooling orifices 32 but arranged in a perpendicular plane. However, while they are still within the ranges of values defined previously, these characteristics of the additional orifices 34 can be substantially different to those of the cooling orifices 32, that is, the inclination θ2 of the additional orifices of the same row relative to a normal N to the annular wall 16, 18 can be different to that θ1 of the cooling orifices, and the diameter d2 of the additional orifices of the same row can be different to that d1 of the cooling orifices 32.

However, according to the preferred cooling need, the additional orifices 34 behind the row of primary holes 28 can also advantageously have characteristics in terms of inclination, diameter or pitch different to those arranged behind the row of dilution holes 30 and, more particularly, within the same zone a difference in the diameter d2 and pitch p2 can also be made to densify this cooling in the most thermally constrained parts, that is, those just downstream of the primary holes and the large dilution orifices, when the latter are formed by alternating large and small orifices, as illustrated in FIG. 2.

Between the row of primary holes and that of the dilution holes, the introduction of gyratory multiperforation prevents the formation of cracks downstream of the primary holes 28 by limiting the elevation of the thermal gradient. Since the upstream multiperforation of the dilution holes 30 from the downstream transition axis 28B is of axial type, it is necessary to provide a transition zone made for example over two rows in which the additional cooling holes 34 are each arranged in a plane inclined with one at 30° and the other at 60° relative to the axial direction D, the other parameters, specifically the diameter d2, the pitch p2 and the inclination θ2 of these additional holes in these inclined planes remaining unchanged.

Similarly, at the chamber output, more precisely from the downstream transition axis 30B (FIG. 2), introduction of axial multiperforation meets the local level of gyration so as not to lose the high-pressure turbine (TuHP) output of the combustion chamber. Preferably, it is also advisable to provide a gyratory-axial multiperforation transition zone for smoothing out flows to reduce the thermal gradient at the origin of the onset of cracks. The average temperature profile at the chamber output is improved due to the resulting more effective mixture. This transition zone can for example be made over two rows of additional cooling holes, each arranged in a plane inclined with one at 30° and the other at 60° relative to the axial direction D, the other parameters, specifically the diameter d2, the pitch p2 and the inclination θ2 of the additional holes in these inclined planes remaining unchanged. In the case of a reverse-flow combustion chamber, this zone from the axis 30B cannot exist or be integrated in the return elbow.

It is evident that if the transition zone has been described at the level of gyratory multiperforation, there is no problem placing it at the level of axial multiperforation or even straddled with a row of axial multiperforation inclined at 30° and a row of gyratory multiperforation inclined at 60°. Similarly, this transition zone can comprise more than two rows, the inclination of the orifices then being distributed evenly between 0° (axial multiperforation) and 90° (gyratory multiperforation). For example, with three rows, the inclination of the orifices will be respectively 22.5°, 45° and 67.5°.

With the invention, the flow in the primary zone is not modified, and gyration does not impact the orientation of the dilution jets and omitting the thermal barrier brings a gain in mass and accordingly cost. It is also evident that to respect the flow directions in the HPD and avoid aerodynamic delaminations and retain the output of the high-pressure turbine, the direction of boring of the gyratory multiperforation is fixed by the orientation of the airfoils of the high-pressure distributor (HPD) downstream of the combustion chamber.

The invention claimed is:

1. An annular wall of a turbine engine combustion chamber, including a cold side and a hot side, the annular wall comprising:

a plurality of primary holes distributed according to a first circumferential row to allow circulating air of the cold side of the annular wall to enter the hot side to create an air/fuel mixture;

a plurality of dilution holes distributed according to a second circumferential row to allow the circulating air of the cold side of the annular wall to enter the hot side to ensure dilution of the air/fuel mixture; and a plurality of first cooling orifices to allow the circulating air of the cold side of the annular wall to enter the hot side to form a film of cooling air along the annular wall, the first cooling orifices being distributed according to a plurality of circumferential rows spaced axially from one another and geometric axes of each of the first cooling orifices being inclined, in an axial direction of a flow of combustion gases, by an angle of inclination θ1 relative to a normal N to the annular wall; and a plurality of second cooling orifices distributed according to a plurality of circumferential rows spaced axially from one another, including a first row of the second cooling orifices arranged immediately downstream of the primary holes, and including a second row of the second cooling orifices arranged immediately downstream of the dilution holes, geometric axes of each of the second cooling orifices being arranged in a plane perpendicular to the axial direction and inclined by an angle of inclination θ2 relative to a normal N to the annular wall, wherein ones of the second cooling orifices in the first row that overlap the primary holes in the axial direction have a greater densification than all of the second cooling orifices in the first row that do not overlap the primary holes in the axial direction, wherein ones of the second cooling orifices in the second row that overlap the dilution holes in the axial direction have a greater densification than all of the second cooling orifices in the second row that do not overlap the dilution holes in the axial direction, and wherein the ones of the second cooling orifices in the first row that overlap the primary holes in the axial direction have a greater densification than ones of the second cooling orifices in a third row of the plurality of circumferential rows of second cooling orifices that overlap the primary holes in the axial direction, the third row being directly downstream from the first row of the second cooling orifices.

2. The wall as claimed in claim 1, wherein the inclination θ2 of the second cooling orifices relative to the normal N to the annular wall is identical to that θ1 of the first cooling orifices.

3. The wall as claimed in claim 1, wherein a diameter d2 of the second cooling orifices is identical to a diameter d1 of the first cooling orifices.

4. The wall as claimed in claim 1, further comprising, at a level of a transition zone formed downstream of a row of the plurality of circumferential rows of second cooling orifices and upstream of a row of the plurality of circumferential rows of first cooling orifices, at least two rows of third cooling orifices that have geometric axes that are inclined, relative to a plane perpendicular to the axial direction, by an inclination determined as different for each of the two rows of the third cooling orifices.

5. The wall as claimed in claim 4, wherein the inclination of the third cooling orifices in a first row of the at least two rows is 30° and the inclination of the third cooling orifices in a second row of the at least two rows is 60°.

6. The wall as claimed in claim 4, wherein the at least two rows of the third cooling orifices are a plurality of rows having the inclinations distributed evenly between 0° and 90°.

7. A combustion chamber of a turbine engine, comprising at least one annular wall as claimed in claim 1.

8. A turbine engine comprising a combustion chamber including at least one annular wall as claimed in claim 1.

9. The wall as claimed in claim 1, wherein at least one row of the plurality of circumferential rows of first cooling orifices overlaps with the first circumferential row of the plurality of primary holes at a same position in the axial direction.

10. The wall as claimed in claim 1, wherein at least one row of the plurality of circumferential rows of first cooling orifices overlaps with the second circumferential row of the plurality of dilution holes at a same position in the axial direction.

11. The wall as claimed in claim 1, wherein the ones of the second cooling orifices in the second row that overlap the dilution holes in the axial direction exhibit greater densification than ones of the second cooling orifices in a fourth row of the plurality of circumferential rows of second cooling orifices that overlap the dilution holes in the axial direction, the fourth row being directly downstream from the second row of the second cooling orifices.

* * * * *